United States Patent [19]

Chasek

[11] 4,257,338

[45] Mar. 24, 1981

[54] PROCESS FOR IMPROVED SOLID FUEL COMBUSTION

[76] Inventor: Norman E. Chasek, 24 Briar Brae Rd., Stamford, Conn. 06903

[21] Appl. No.: 944,411

[22] Filed: Sep. 21, 1978

[51] Int. Cl.[3] ..... F23B 7/00

[52] U.S. Cl. ..... 110/341; 110/234; 110/293; 126/120; 126/164; 55/DIG. 30

[58] Field of Search ..... 126/120, 164, 121, 165, 126/299 R, 132, 181, 152 R, 152 B; 55/DIG. 30; 110/341, 229, 234, 204, 101 R, 108, 293, 285, 291

[56] References Cited

U.S. PATENT DOCUMENTS

| | | | |
|---|---|---|---|
| 1,443,612 | 1/1923 | Barfield | 126/173 |
| 2,414,033 | 1/1947 | Flaacke | 126/164 |
| 2,677,601 | 5/1954 | Ruth | 55/DIG. 30 |
| 3,910,252 | 10/1975 | Richard | 126/120 |
| 4,069,808 | 1/1978 | Cranberg | 126/164 |

FOREIGN PATENT DOCUMENTS

| | | | |
|---|---|---|---|
| 653944 | 11/1937 | Fed. Rep. of Germany | 126/120 |
| 1344299 | 10/1963 | France | 126/121 |
| 1646 | of 1914 | United Kingdom | 126/165 |
| 180192 | 5/1922 | United Kingdom | 126/120 |
| 334039 | 8/1930 | United Kingdom | 126/132 |
| 594069 | 11/1947 | United Kingdom | 126/164 |

*Primary Examiner*—Carroll B. Dority, Jr.
*Assistant Examiner*—Lee E. Barrett
*Attorney, Agent, or Firm*—Parmelee, Johnson, Bollinger & Bramblett

[57] ABSTRACT

Novel solid fuel combustion and heat transfer geometry/process and illustrative embodiments, which include log burning space heaters, a boiler and a hot air heat exchanger are described. The illustrative boiler embodiment depicts a standard module that when joined with other similar modules makes the construction of any size boiler possible. The combuster is designed to burn nearly any solid fuel, depending on price and availability, and also incorporates an auxilliary fuel oil combuster to either aid in the combustion of certain solid fuels or to convert over entirely to fuel oil. This novel geometry/process consists of solid fuel dispersed over two nearly intersecting surfaces with a third adjustable surface introduced to provide control of the combustion rate by a mutual radiant feedback. The fuel retaining surfaces are so constructed and positioned to enhance radiant heat interchange which maintains highest combustion temperatures along fuel surfaces that are directed toward the heat absorbing medium. This provides a focusing of radiant heat emissions from the combusting solid fuel that substantially increases the radiant heat output. The fuel moves, with the aid of gravity through the physically separate zones that constitute the combustion cycle. One set of these intersecting fuel retaining surfaces forms a radiant space heater and two sets, placed face to face, in a common enclosure, forms a furnace. An adjustable shutter between the two units that comprise the furnace controls the combustion rate to suit fuels of varying combustability. The geometry also lends itself to the inclusion of simpler emissions filtering apparatus because the early combustion emission gas loop is readily separable from the main combustion supporting air stream.

24 Claims, 8 Drawing Figures

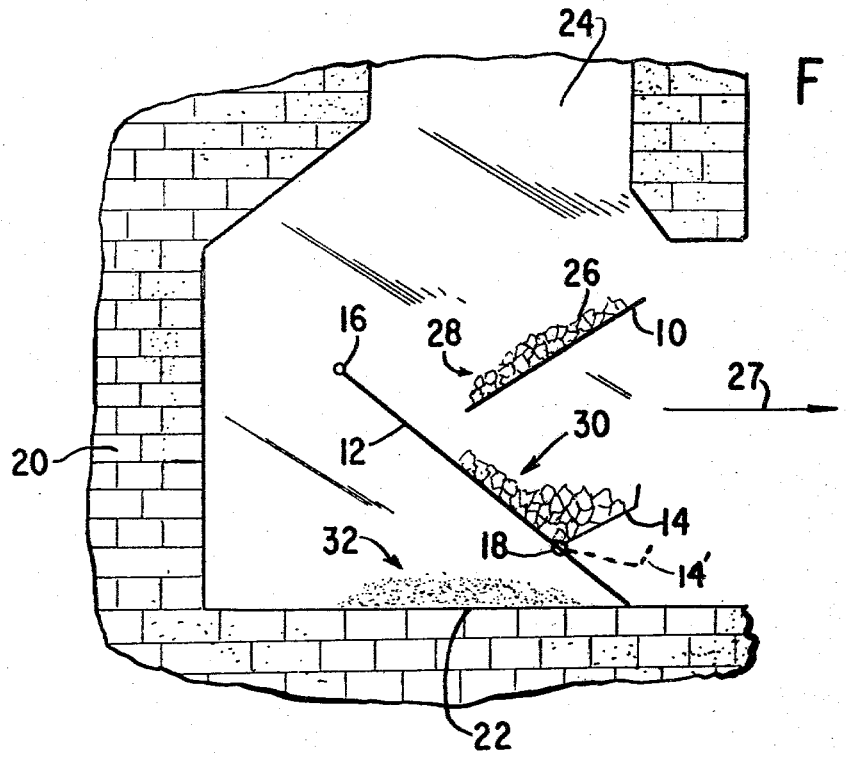
FIG. 1
FIG. 2
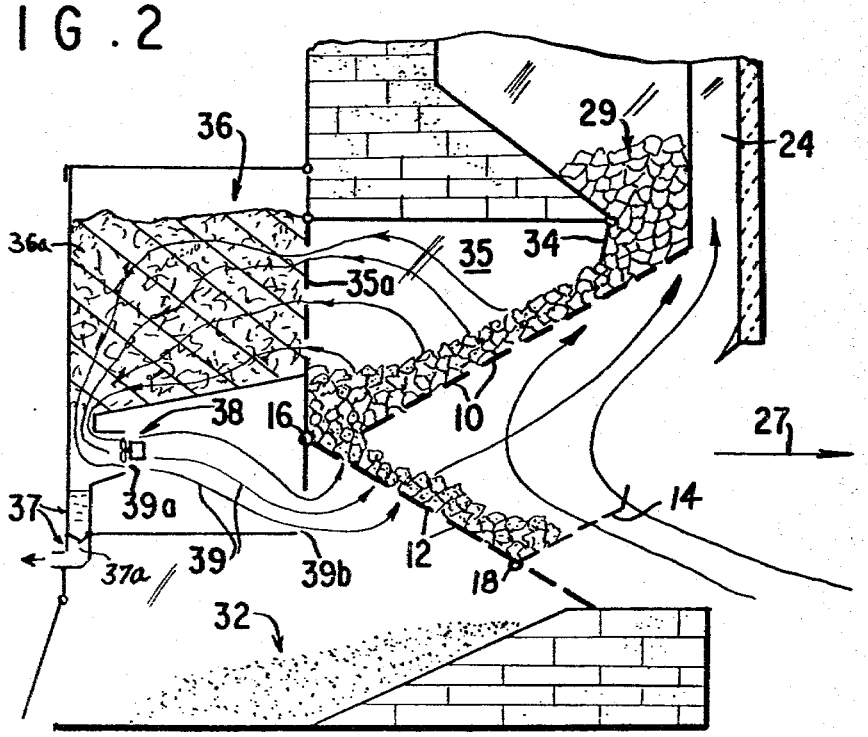

DETAIL OF SHAFT WITH CAM FLATS & GRATE STRIPS

PROCESS FOR IMPROVED SOLID FUEL COMBUSTION

BACKGROUND OF THE INVENTION

Solid fuels represent a much greater percentage of the earth's known fuel reserves than oil or gas. It is therefore advantageous to develop more convenient, lower cost and more versatile methods of heating with a variety of solid fuels. The simplest, most direct method of heating with solid fuels is to make direct use of the efficient, heat radiating source that solid fuels become when they are very hot. Radiant heat is the quickest and most efficient means of transferring heat from solid fuel to non-gaseous heat absorbers. Maintaining high temperatures on emitting surfaces and better focusing of the radiant heat in the direction of utilization are key to efficient radiant heating. This can be understood better from the following expression for radiant heat energy exchange:

$$E = (T_2^4 - T_1^4)\frac{A_1E_1}{d^2}(KEA)$$

E is the radiant heat energy

T2 is the temperature of the heat source

T1 is the temperature of the heat recipient

A1 is the effective aperture area of the heat source

E1 is the emissivity of the heat source d is the distance between the heat source and recipient KEA is the emissivity and aperture area of the heat recipient.

The combustion process, which is the source of heat energy, is a function of the fuel temperature and the availability of oxygen. When excessive demand for heat is placed on the combusting solid fuel, the heat transfer rate might exceed the supply of heat energy. This causes the fuel temperature to drop until an energy flow balance is achieved. This drop in fuel temperature can impair combustion efficiency or stop the combustion itself. The variability of solid fuels, particularly their moisture content, further complicates combustion. Solid fuel combustion units require more elaborate fire tending than other types of fuel burners. The fire tending includes continual insertion of fuel, poking and ash removal. Solid fuel combustion units also tend to have more air polluting emissions. The large variety of solid fuels, which include coals, peat, lignite, wood and various waste products contain various impurities and also have different degrees of combustibility. Many of the problem impurities that occur in solid fuels tend to burn off at lower temperatures. A combustion process where early combustion occurs in specified areas and where the emissions from this combustion are easily separated from the main flow of combustion supporting air, makes the processing of emissions easier to achieve.

It will become increasingly important in the future to have combusters that are flexible, burning a variety of fuels in a given combuster, for economic reasons. Also for both environmental and economic reasons, it will become increasingly attractive to burn sludge, garbage, tree bark, etc., converting these items into useful heat energy.

In the home, the fireplace, which has become largely ornamental, has potential as an auxiliary and emergency heating and cooking source. Improving the space heating efficiency of the woodburning fireplace, without destroying the mood created by an open fire, would be useful for many homes.

SUMMARY OF THE INVENTION

The radiant combustion (R-C) process generates highly efficient, focussed radiant heat from solid fuels such as wood, coal and peat. It includes a feed back means for controlling the combustion rate without restricting air flow and a means for gravity feeding fresh fuel into the combustion area as existing fuel is consumed. The R-C process contains four areas through which the fuel moves, a storage pre-heating area, an early combustion area, an advanced combustion area and an ash elimination area. Apparatus utilizing the R-C process comprises mechanical supporting means that positions the fuel in relatively thin layers along two fuel areas that generally extend at a positive and negative angle from the median plane of maximum radiant heat transfer. This geometry maintains a high rate of combustion and hence high temperature along the surfaces that are most needed for radiant heat emission by mutually resupplying radiant energy to compensate for the radiant heat transferred to the exterior. The rate of combustion can be controlled by varying the physical separation of fuel in the two fuel areas.

The two fuel retaining surfaces are tilted with respect to the gravitational field so that gravity moves fuel through the combustion areas. The fuel in the upper fuel area, which also acts as a fuel magazine, absorbs heat released from the lower area. This pre-heats and dries the fresh fuel so that energy is not absorbed directly from combustion areas for this purpose. This better maintains the high temperature of the combustion area as fresh fuel is fed into it. The specific design of the two fuel retaining surfaces depends on the fuel to be used.

A practical implementation of the R-C process into a unit for wood burning, that sets into a fireplace, is described. This unit consists of two parallel curved steel rods inclined roughly at a 45° angle from the horizontal and comprises one fuel retaining surface. The second fuel retaining surface is comprised of two layers of steel mesh, one a fine mesh and the second a coarse mesh or a cast iron surface that approximates this effect. The steel rods support logs and the steel mesh supports logs, embers and chunks of wood. A third surface, generally at some variable angle with respect to the second surface, and the hinged lower fuel retaining surface control rate of fuel combustion for different wood and wood conditions.

A coal burning R-C radiant space heater is illustrated that includes a fuel hopper and fuel feed control. The area above the upper fuel retaining plane is closed off and the early combustion emissions are drawn out of this area through a bed of wet $C_aCO_3$ to filter out $SO_2$. This air, with the $SO_2$ filtered out, is then reinserted into the main combustion supporting air stream.

A furnace configuration is illustrated with illustrative steam and hot air heat exchangers. The furnace is created by placing two R-C combustion units face to face within a common enclosure. The heat exchangers are placed between the two face to face units. By designing the heat exchangers with adjustable windows, the combuster can mutually exchange radiant heat energy, thus providing an adjustable means for combustion feedback control to suit fuels with varying degrees of combustibility. An adjustable feedback shutter for the two heat exchangers is illustrated. Depending on the temperature of the combustion process desired and the combustibility of the fuels used, this shutter is raised or lowered appropriately. In addition, a means for recovering heat lost in combustion steam is illustrated which consists of inserting a condenser in the early emission filter area. A means of reducing odors from certain fuels consists of activated carbon filters placed in the emission filter area. Each combuster that comprises the furnace can burn a different fuel from the other. This can have economic or convenience advantages or can be used to improve the combustion of certain fuels.

Also illustrated is the insertion of fuel oil nozzles into the axial end plates of the furnace to either assist in the combustion of certain fuels or to convert, when desirable, to a fuel oil fired furnace.

The various aspects and advantages of the invention will be more fully understood from a consideration of the following detailed description in conjunction with the accompanying drawings in which:

FIG. 1 is a schematic drawing illustrating the basic radiant-combustion process.

FIG. 2 is a schematic drawing illustrating a coal fired space heater R-C process to reduce air polluting emissions.

FIG. 4 is an enlarged partial sectional view taken along line 4—4 in FIG. 3B.

DETAILED DESCRIPTION OF EMBODIMENTS OF THE INVENTION

Figure 3A:
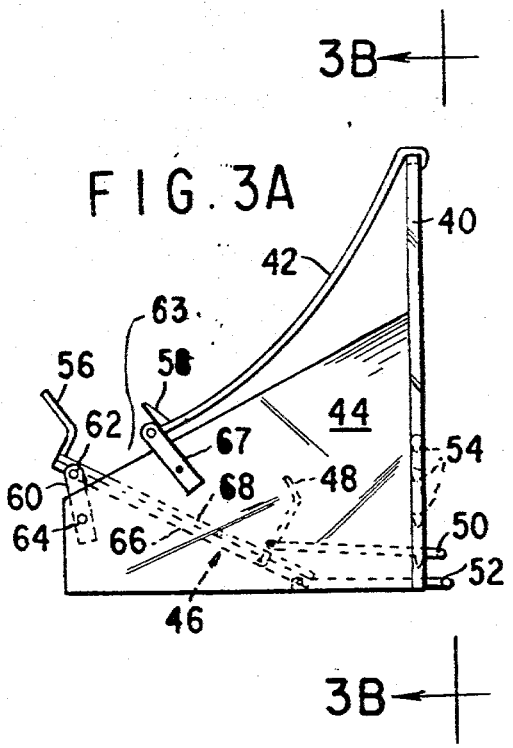
FIGS. 3A and 3B are front and side views of a wood burning implementation of the radiant combustion process.

The temperature of combusting fuel depends on the combustibility of the fuel and the effective heat absorbing medium temperature that surrounds the fuel. If a piece of fuel is surrounded by high temperature, it will radiate little heat outward, hence most of its combustion heat is retained. This raises the temperature of the fuel and increases the combustion rate. On the other hand, if the fuel is surrounded by cool temperature, its heat radiates out rapidly and its temperature will drop to restore a balance between the heat source and demand. This invention describes a combustion geometry that controls the amount of radiant heat emissions from combusting fuels on specified surfaces by the physical relationship of the combusting surfaces to each other.

The R-C process depends on two or more relatively thin layers of fuel that are arranged to mutually exchange some of their radiant heat and hot gases in order to maintain higher combustion temperature on the surfaces of the fuel facing in the direction of heat utilization. This exchange is controlled by the physical position of the surfaces as well as any other means that controls the amount of heat being transferred out to the amount of heat retained to sustain combustion. By maintaining highest combustion temperatures on the fuel surfaces pointing in the direction of utilization, efficient heat transfer via a radiant heat means is achieved. Referring to FIG. 1, if fuel surface 12 is raised, it will reduce the solid angle of cool temperature 27 that fuel on surface 10 and 12 sees. This will raise the combusting temperature of the fuel. If surface 14 is raised, the coals retained by it radiate their heat back onto the fuel retained on surfaces 10 and 12. This increases their combusting temperatures. If surface 14 is lowered, more fuel is exposed to a larger solid angle of cold temperature 27 and combustion temperatures will drop. The specific construction and shape of these surfaces will depend on the fuel being combusted and specific problems of fuel and smoke flow.

If the thickness of the fuel on each surface becomes sufficiently large, self sustained combustion will occur on those surfaces that are less dependent on the heat exchange provided by the R-C process. The result is less combustion control and less efficient outward heat focusing because more of the combustion zone is blocked from radiating heat in the desired direction by intervening fuel. This converts more of the heat to upward flowing hot gases instead of radiant heat directed in a preferred horizontal direction 27.

Referring to the drawings in detail, FIG. 1 shows an embodiment of the R-C process. The supporting means for fuel dispersed on the upper fuel area is 10. The specific design of the supporting means 10 depends on the fuel to be burned. Its surface should retain the fuel and allow for radiant heat and hot gases to flow through it. In a woodburner, the supporting means 10 is best realized by two rails which support logs. For coal, the supporting means 10 can be realized by a suitable steel or cast iron mesh. The lower fuel support surface is 12. This surface should allow both ash and air to pass through it. Fuel support surface 12 pivots on hinge point 16 as a means of adjusting the combustion rate. The fuel is restricted to a particular area on the support surface 12 by retainer surface 14 which is constructed of steel mesh that is nearly transparent to the radiant energy flow. Pivoting the retainer surface 14 about hinge point 18 controls the amount of heat that is fed back to support the combustion process. When surface 14 is up, more heat is fed back and this accelerates the combustion rate. Dropping surface 14 so that it lies flat on the support surface 12 slows the combustion rate by increasing the flow in direction 27 of outward directed radiant heat. The R-C apparatus is enclosed with a rear fire wall, 20, a fire floor, 22 and a flue, 24.

The fuel located in area or zone 26 consists of fresh fuel generally not yet combusting. This fuel absorbs waste heat from fuel in other combusting areas which dries and preheats it. As the fuel in lower areas is consumed, this fuel progresses down into area or zone 28 where it begins burning. It then falls into area or zone 30 where more complete combustion occurs. Ash then falls through the openings in the support surface 12 into the ash collection area 32.

Many of the impurities in solid fuel burn off at a relatively low temperature. These impurities can include sulfur, moisture or other chemicals that might produce odors. By positioning the early combusting fuel under an enclosed area where the early combustion emissions can be drawn off without interfering with the main flow of combustion supporting air, more convenient and more efficient methods of either filtering out the emission products or recovering the heat from combustion steam can be designed.

FIG. 2 is a schematic drawing that illustrates an R-C apparatus version for coal burning. This version includes a means for reducing air pollution and provides for a fuel hopper. Surface 10 is porous to radiant heat and hot gases, yet retains coal. Surface 12 passes ashes down and air up through it. Surface 12 is hinged at 16. The flue, 24, is relocated from FIG. 1 to make room for the fuel hopper, 29, the emission gas collection area 35 and the emission gas filtering area 36. Hinged vertical gate 34 restricts the flow of coal from hopper 29 onto surface 10. The gases that collect in area 35 are drawn through mesh surface 35*a*, through a suitable gas filtering means, 36*a*, in area 36, and then through outlet 39*a* into area 39 by an exhaust fan 38. These gases are then both pushed and drawn through opening 39*b* passing back through grill surface 12 and exiting through flue 24. Area 37 is provided to exhaust any waste fluids required by the gas filtering means such as would be the case if wet $CaCO_3$ is used to absorb $SO_2$. In this case, $H_2SO_3$ exhausts through duct 37 and a one-way valve 37*a* blocks the intake of air through this duct. Area 32 is for ash collection and removal.

Since many air pollutants, such as $SO_2$, burn off in the early combustion phase, the area above surface 10, where the early combustion occurs, is closed off. The emissions from surface 10 are drawn off and passed through suitable filters. The filtered gases are then passed back through the combustion area and exhausted through flue 24 which primarily exhausts the air used for oxidation. The gas flow paths are shown by arrows in FIG. 2. The unrestricted air flow and thin coal beds also produce minimal carbon monoxide.

The possibility that the R-C geometry offers, of separating the early combustion emissions, as a distinct gas loop, from the main combustion supporting air stream, will make emissions filtering far easier to realize than in other combustion geometries. The emissions filtering apparatus in this case will have to process a much lesser volume of hot gases, which are at a lower temperature and which contain a much higher concentration of the substances to be filtered out. Although FIG. 2 illustrates one method of filtering $SO_2$, there may be better methods available. Furthermore, the early combustion emissions filter area 36 can also be used to absorb odors such as from peat or sludge using activated carbon filters or to recover heat energy from combustion steam driven off during the preheating of high moisture fuel. The early combustion emission gases can be more optimally concentrated by controlling the combustion rate and combustion temperature of the fuel on the upper fuel surface. This can be achieved by controlling the r.p.m. of the exhaust fan, 38. The r.p.m. could, for example, be controlled by a servo feedback loop that includes a temperature monitor inserted in the emissions gas collection area 35.

Figure 3B:
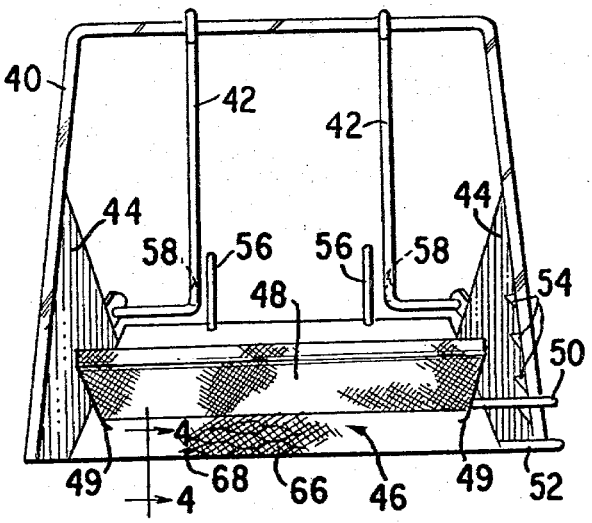

FIGS. 3B and 3A show front and side views of a illustrative woodburning embodiment of an R-C unit that is designed to be set inside a fireplace enclosure. The front support frame 40 supports curved rails, 42, that defines the upper fuel plane. The rail curvature improves the mutual radiant heat reinforcement while reducing the chance of waste gases entering the room. Metal side wall 44 acts to support the lower end of the rails and the pivot points for surface 46. The lower fuel support surface 46 consists of two layers of steel mesh.

Figure 4:
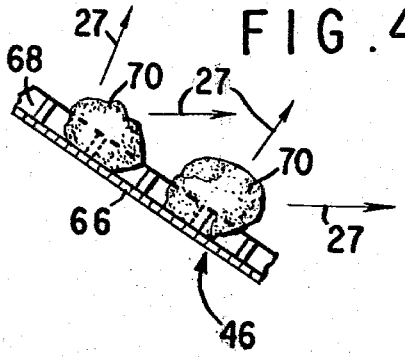
FIG. 4 shows construction and functional sectional detail of the lower fuel surface used by the unit shown in FIGS. 3A and 3B.

FIG. 4 shows surface 46 in detail. The coarse expanded metal mesh 68, with openings of about $1\frac{1}{2}'' \times 3''$, is on top and the fine mesh 66 with openings of about $\frac{3}{8}'' \times \frac{3}{4}''$ is on the bottom. The heavy mesh 68 provides mechanical strength and also traps embers in its pockets. The fine mesh prevents the embers from falling through before burning to ash. The fine mesh has a tendency to hold some ash which prevents heat loss through the bottom and controls the combustion rate. FIG. 4 shows two embers 70 entrapped in adjacent pockets. The arrows 27 show the directions of radiant energy flow.

Retainer surface 48, is also constructed of steel mesh, reinforced along the edges. Retainer surface 48 has two protrusions 49 (FIG. 3B) along the bottom lip which grips the surface of 46 which allows retainer surface 48 to be positioned anywhere along surface 46 and still be pivoted about its lower edge. Handle 50, which is attached to the lower edge of 48, rests on one of several retaining notches 54. They hold surface 48 in any desired position. A second handle, 52, is attached to the front lip of the lower fuel support surface 46. Positioning this handle onto a selected notch allows a desired position of surface 46 to be maintained.

The two vertical back stays, 56, keep logs from rolling out of the back of the unit. They also help funnel fuel more optimally from the upper to lower fuel planes. The two protruding stops, 58, located on the inside, lower corners of rails 42, relieve downward pressure created by the wood stored along rails 42. This pressure would normally tend to block the smooth flow of fuel. The stops 58 and stays 56 also act to keep a rear air gap 63 open to allow smoke to escape to the rear of the unit and up the back wall of the fireplace enclosure.

A removable, open top ash receptacle can be positioned below surface 46 to facilitate ash removal. The configuration of surfaces 46 and 48 provides a unique means of cooking food and particularly broiling meat. The tilt of surface 46 sets up a smoke flow pattern in which the smoke moves back and up, whereas the radiant heat flows forward. By positioning surface 48 appropriately, several methods for clean, smoke free cooking are possible. For example, surface 48 can be set horizontal and filled with coals. Then a metal mesh surface suspended between the two legs of frame 40, over the coals, provides a general purpose cooking surface. Adjustments in the position of surface 46 will vary the amount of heat for cooking. If surface 48 is free of coals, broiling pans can be placed on this surface. Tilting surface 48 upward to face coals on surface 46 provides for grease free broiling of meat. Coals can be placed on surface 48 and pans suspended over the coals between the forward lip of 48 and its hinge to provide yet another cooking configuration.

Figure 5:
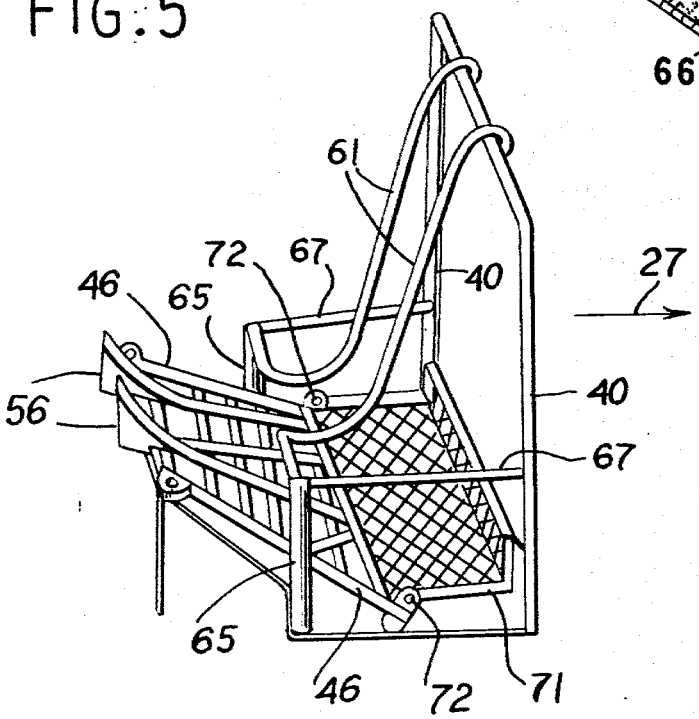
FIG. 5 illustrates a production version of a log burning radiant combuster.

FIG. 5 illustrates the side view of second embodiment of a woodburning fireplace unit. In this unit, rails, 61, have increased curvature to reduce the size of the unit and also to better deflect the smoke into the chimney. The lower fuel surface, 46, is constructed of cast iron which approximates the properties of the grate illustrated by FIG. 3, but at less cost. The curved back stays, 56, are included as part of the casting. The solid metal sides are eliminated and in place, a steel pipe column, 65, supports the cantelevered rails, 61. Support member, 67, helps stiffen the front arch 40 and the pipe column 65 and also serves to support a cooking grate for cooking. The adjustable surface, 71, rotates about fixed pivots, 72.

The position of the pivoted combustion control surface 46 or 71 controls the combustion rate of the fuel. Surfaces 46 or 71 also serve other purposes. They help quickly start a fire even with damp wood. When surface 46 or 71 is covered with wood and in a maximum raised position, all of the heat of the initial combustion is trapped helping the fire start up quickly. After the combustion is well established, surface 46 or 71 can be lowered to release radiant heat into the room. If the fire slows too much, surface 46 or 71 can be raised again. At the end of an evening the embers and coals can be quickly burned up and the chimney vent closed by raking all of the coals and embers onto surface 46 or 71 which is set in a horizontal position. Rapping this surface with a poker causes small coals to fall through the grate surface onto the fireplace floor. This sets up a closely spaced parallel relationship of two combusting masses with ample air supply which causes the fuel to very rapidly burn up.

Figure 6A:
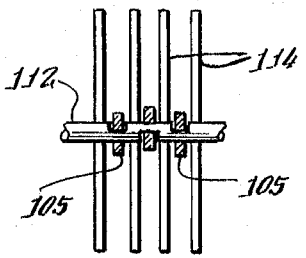
FIG. 6A is a detail view for showing the structure of the grate strips and their actuating shaft.
Figure 6:
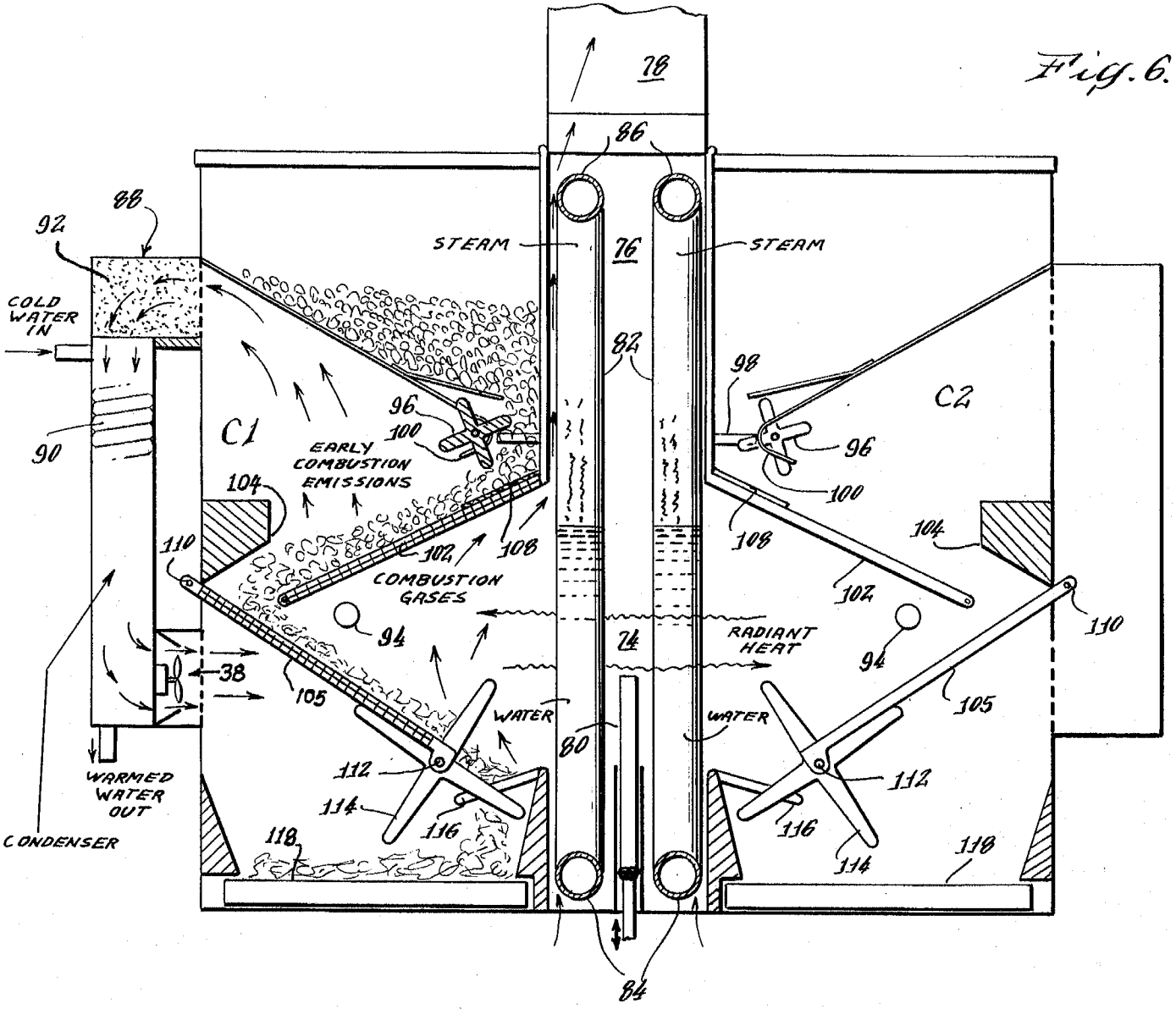
FIG. 6 illustrates a multiple fuel boiler module embodiment of the invention.

FIG. 6 illustrates a furnace/boiler module comprised of two combusters $C_1$ and $C_2$ placed face to face in a common enclosure. This furnace has a radiant heat exchange area 74 and a gaseous heat exchange area 76. The exhaust occurs through a common stack 78 at one end of the furnace. Controlling the amount of common radiant visability between the two combusters by placing an adjustable shutter 80 between the two combusters controls mutual radiant feedback, thereby realizing a combustion control 80. This control adjusts the furnace for efficient combustion using a wide range of fuels with different degrees of combustibility. The specific embodiment of FIG. 6 illustrates a boiler heat exchanger. The vertical boiler pipes 82 are spaced to allow mutual visibility window areas. Shutter 80 controls the window area by raising or lowering it. The shutter can be a sheet of asbestos or cast iron. Its surface is cooled by its proximity to the water pipes. The boiler pipes are joined by a common bottom feedwater pipe, 84, and a common top steam pipe, 86. The water level in the pipes covers the radiant heat exchange area 74. Steam temperature is increased in the gaseous exchange area 76.

The focusing properties of the R-C geometry substantially reduce the amount of heat that the exterior walls of this furnace must withstand. This allows furnace temperatures to be increased or allows furnace walls to be more lightly constructed.

The emissions filter area, 88, shown in FIG. 6, incorporates a condenser coil 90 through which the combustion steam is drawn from the early combustion area. Cold feed water condenses this steam and both the condensed steam and the warmed feed water can be used to feed the boiler pipes. Activated charcoal filter, 92, is inserted into emissions filter area, 88, to absorb odors from combusting solid fuels such as peat or sludge.

Oil nozzles, 94, can be inserted axially into the end plates to either aid the combustion of some fuels or to convert the unit into an oil fired combuster. Each side of the furnace can optionally burn a different fuel. This allows great flexibility in the application of the furnace both with regard to the economics of its operation, using the least expensive fuels available at any time or to aid in the combustion efficiency where certain combinations of fuel can work well together. By joining a number of boiler modules together, any size unit can be constructed.

FIG. 6 illustrates one possible method of moving the fuel from the hopper, along the combustion surfaces and onto an ash removing conveyor belt. Motor driven vanes, 96, located at the mouth of the hopper interleave with fixed vanes, 98. The bottom of the hopper has slits in the vicinity of the moving vanes to allow them to rotate through this surface. This hopper bottom surface is then curved to form fuel deflecting surface, 100, which projects the propulsion force of each vane down along the layer of fuel dispersed, on the upper fuel surface, 102 onto fuel deflector, 104, which is constructed of refractory material. Fuel deflector, 104, forces the fuel down onto the lower fuel surface, 105. The upper grate surface, 102, consists of parallel steel or cast iron strips running downward. A plate, 108, covers the upper grate openings to prevent fuel from being jammed into the grating by moving vane 96. Plate 108 also prevents premature combustion of fuel at the mouth of the hopper.

The lower grate 105 also consists of parallel steel or cast iron strips that run downward. These strips are closer spaced than those on surface 102. This gate is suspended by two rods, 110 and 112. Upper rod, 110, is anchored to the side wall and each strip is free to independently rotate about the rod. Spacers maintain the spacing between strips. Lower rod, 112, passes through holes (FIG. 6A) in each strip and is welded to a series of parallel four vane wheels, 114, which are rotated by rod, 112, which is motor driven. Rod 112 incorporates flats cut in the vicinity of each strip with the flat alternating its position 180° between adjacent strips. This forces each strip to move up and down with respect to each other as rod 112 rotates, causing a grinding action which eliminates ash, helps in the fuel propulsion and eliminates clogs in the grating. The rotating four vaned wheels, 114, lift the remaining ash, turn it and deposits it on a second set of fixed vanes 116 that interleave with the wheel vanes. When the two sets of vanes subsequently interleave, all ash is forced downward onto the conveyor belt, 118.

The use of a conveyor belt 118 for ash removal makes damper control of a furnace less exact. The R-C process however does not primarily depend on damper control for its combustion control. A conversion of this solid fuel combuster to a fuel oil combuster would consist of laying refractory sheets over the top grate and under the lower grate. The grates become secondary radiant heat emitters and the refractory surfaces insulate and better focus this heat back into the heat exchange area 74.

Figure 7:
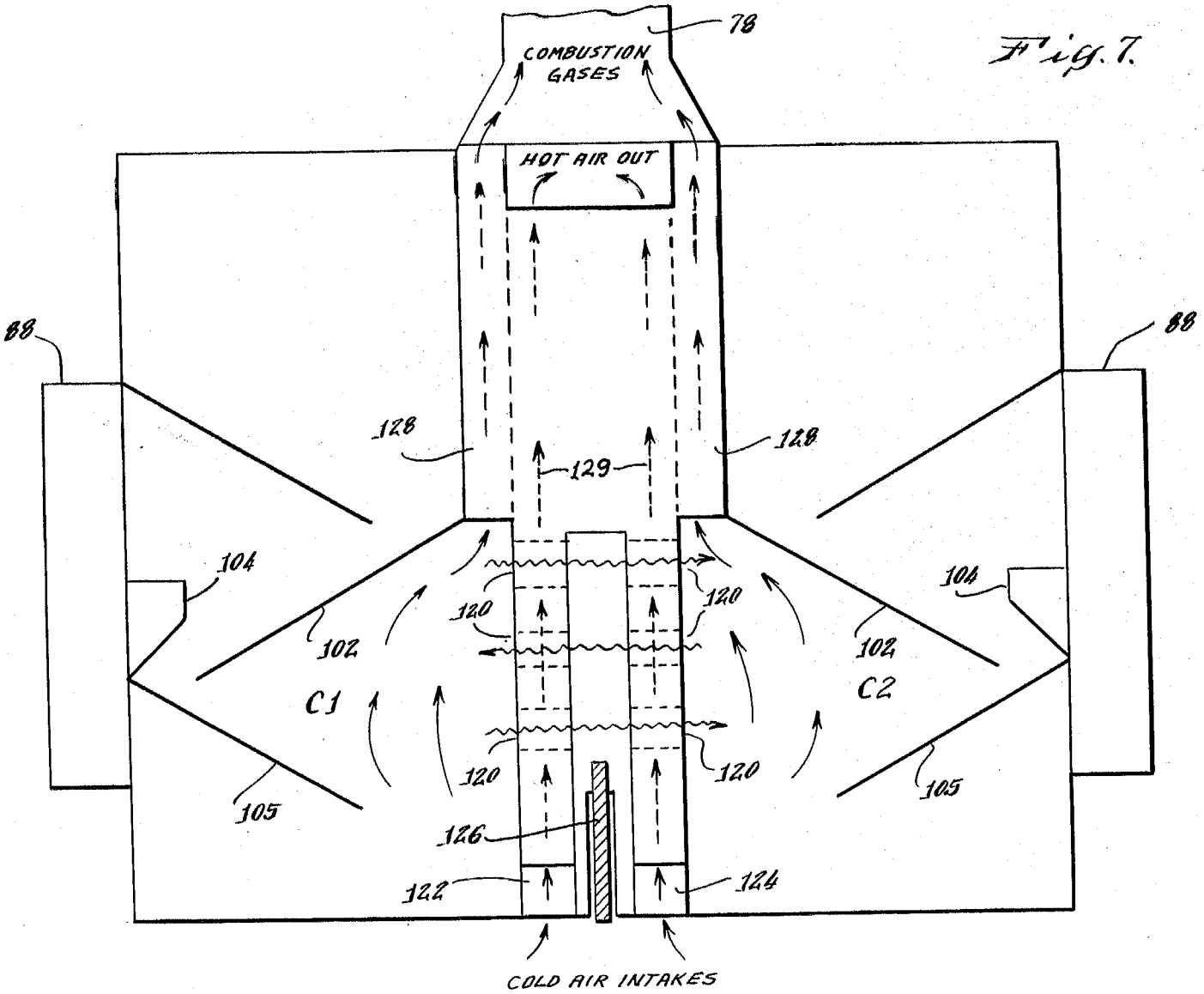
FIG. 7 illustrates a hot air heat exchanger embodiment of the invention.

FIG. 7 illustrates a hot air heat exchanger in which horizontal ducts or pipes 120 are inserted through two vertical hot air ducts 122 and 124. An adjustable shutter 126 is inserted between the two vertical ducts to adjust the combustion feedback, via the horizontal ducts or pipes between combusters, for combustion control. The horizontal ducts or pipes 120, in addition to providing radiant heat transfer between combusters, also improve the heat transfer to passing air. The hot gases from combustion travel up through the vertical pipes 128 that cut through the hot air duct space, where it is widened to fill the entire heat exchange area, and transfer the heat from the hot combustion gases to the passing clean air 129.

I claim:

1. A process for providing improved combustion and focussed radiant heat energy transfer from a combusting solid fuel comprising the steps of:

providing a front region through which radiant heat energy can pass;

providing a first inclined combustion zone having an upper portion and sloping downwardly and rearwardly from said upper portion in an inclined downward direction away from said front region;

providing a second inclined combustion zone positioned generally below said first zone and having a second upper portion, said second inclined zone sloping downwardly and forwardly away from said second upper portion in an inclined downward direction toward said front region;

supplying the solid fuel to be burned to said upper portion of said first inclined combustion zone;

allowing the solid fuel to progress downwardly and rearwardly along said first combustion zone;

allowing the solid fuel to transfer from the rear of said first combustion zone to said upper portion of said second combustion zone;

allowing the solid fuel to progress downwardly and forwardly along said second combustion zone while the fuel is burning for causing the burning fuel to radiate heat energy forwardly toward said front region and also to radiate heat energy upwardly toward the inclined lower surface of said first combustion zone;

for heating the fuel in said first combustion zone for driving off impurities therefrom as gaseous emissions and for beginning to burn the fuel along said first combustion zone for causing the burning fuel along said first combustion zone to radiate heat energy forwardly from the inclined lower surface of said first combustion zone toward said region and also downwardly toward the upper surface of said second combustion zone;

thereby providing for radiant heat energy to be radiated and transferred between said lower and upper surfaces while both of said surfaces are radiating forwardly toward said front region;

controlling the temperature of combustion by varying the physical separation between said combustion zones; and utilizing the heat energy radiated forwardly toward said front region in a generally focussed manner by said lower and upper surfaces.

2. A process for providing improved combustion and focussed radiant heat energy transfer from a combusting solid fuel as claimed in claim 1, including the steps of:

directing said gaseous emissions rearwardly to a rear region generally away from said front region;

filtering said gaseous emissions in said rear region; and returning the filtered gases forwardly to a region below said second inclined combustion zone.

3. A process for providing improved combustion and focussed radiant heat energy transfer from a combusting solid fuel as claimed in claim 1 or 2, in which:

the physical separation between said combustion zones is varied for controlling the temperature of combustion by changing the relative inclination of said inclined combustion zones with respect to each other.

4. A process for providing improved combustion and focussed radiant heat energy transfer from a combusting solid fuel as claimed in claim 1 or 2, in which:

the physical separation between said combustion zones is varied for controlling the temperature of combustion by elevating or lowering the forward lower portion of said inclined second combustion zone.

5. A process for improved combustion and focussed radiant heat transfer from combusting solid fuels such as wood, coal or peat, comprising the steps of:

providing a first inclined solid-fuel-retaining surface which slopes downwardly in a first direction for causing lumps of solid fuel to progress downwardly along said first inclined surface in said first direction, providing openings in said first inclined surface for allowing heat energy to radiate downwardly therethrough and for allowing gases to flow therethrough, introducing the incoming lumps or chunks of solid fuel onto the upper portion of said first fuel-retaining surface, providing a second inclined solid-fuel-retaining surface below said first inclined surface and sloping downwardly in a second direction opposite to said first direction for causing lumps of solid fuel to progress downwardly along said second inclined surface in said second direction, positioning the upper portion of said second inclined surface for receiving the solid fuel progressing downwardly off from the lower portion of said first inclined surface, positioning the main area of said second inclined surface below and facing upwardly toward said first inclined surface, providing openings in said second inclined surface for allowing ashes to pass downwardly therethrough and for allowing gases to flow therethrough, intensely burning fuel on said second inclined surface causing radiant heat energy to radiate upwardly and hot gases to flow upwardly toward the underside of the fuel on said first inclined surface for causing the fuel on said first inclined surface to become preheated and dried and to commence burning as it progresses downwardly along said first inclined surface, allowing the dried, burning fuel to continue burning with increasing intensity as it transfers from the lower portion of the first inclined surface onto the upper portion of said second inclined surface and as it progresses downwardly along said second inclined surface, flowing air upwardly past the intensely burning fuel on said second inclined surface and then past the fuel on said first inclined surface for carrying on the combustion of the fuel, allowing the radiant heat energy from the commencing burning fuel on said first inclined surface to radiate down onto the intensely burning fuel on said second inclined surface for aiding in said intense combustion, allowing the radiant heat energy output from said intensely burning fuel on said second inclined surface and from the bottom of said commencing burning fuel on said first inclined surface to travel generally horizontally in said second direction away from said first and second inclined surfaces, said radiant heat energy output travelling toward a predetermined vertical plane, absorbing said radiant heat energy output for useful purposes near said vertical plane, conducting the flue gases resulting from combustion toward an outlet located near said vertical plane and above said first inclined surface, allowing the ashes to fall down through said second inclined surface into a region below said second inclined surface, and removing the ashes from said region below said second inclined surface.

6. The process claimed in claim 5, in which the combustion temperature is controlled by adjusting the angle defined between said first and second inclined surfaces.

7. The process claimed in claim 5, including a third fuel-retaining surface which pivots along an axis parallel to the lower portion of the second inclined surface for controlling the intensity of combustion on said second inclined surface.

8. The process as claimed in claim 5, including the steps of:

enclosing the region above the commencing burning fuel on said first inclined surface, defining a gas flow loop extending from said enclosed region above said first inclined surface to said other region below said second inclined surface, circulating the gaseous emissions from said commencing burning fuel through said gas flow loop, treating the gaseous emissions in said gas flow loop to remove pollutants, and returning the treated gaseous emissions into said other region below said second inclined surface for passing upwardly through said second inclined surface for participating in combustion.

9. The process as claimed in claim 5 or 8, including the steps of:

moving the lumps or chunks of fuel downwardly from a hopper onto the upper portion of said first inclined surface, and blocking the radiant heat energy from the fuel moving downwardly from the hopper onto said first inclined surface for preventing premature combustion thereof.

10. The process as claimed in claim 8, including the steps of:

removing sulphur dioxide ($SO_2$) from the gaseous combustion emissions being recirculated through said treatment loop before returning the treated gaseous emissions for combustion.

11. The process as claimed in claim 8 or 10, including the steps of:

removing heat energy from the gaseous combustion emissions recirculating in said treatment loop before returning the treated gaseous emissions for combustion.

12. The process as claimed in claim 8 or 10, including the step of:

condensing moisture from the gaseus combustion emissions recirculating in said treatment loop before returning the treated gaseous emissions for combustion.

13. The process as claimed in claim 8 or 10, including the step of:

removing odor-causing constituents from the gaseous combustion emissions being recirculated in said treatment loop before returning the treated gaseous emissions for combustion.

14. The process as claimed in claim 5, including the steps of:

repeating all of said steps in mirror image on the opposite side of said predetermined vertical plane for generating additional radiant heat energy output travelling generally horizontally toward said vertical plane from the opposite side thereof than said first and second inclined planes.

15. The process as claimed in claim 14, including the step of:

controlling the amount of radiant heat energy travelling in opposite directions through said predetermined vertical plane for controlling the combustion rate.

16. The process as claimed in claim 5, 14 or 15, including the step of:

providing for the introduction of fluid fuel for aiding in the combustion of solid fuels which are relatively less readily burned.

17. The process as claimed in claim 5, including the step of:

deflecting the lumps or chunks of solid fuel downwardly off from the lower portion of said first inclined surface onto the upper portion of said second inclined surface.

18. The process as claimed in claim 14, in which:

said mirror image steps are carried out in modular form on opposite sides of said predetermined vertical plane.

19. The process of claim 8 or 10, in which the gaseous emissions are drawn through an emissions filter area by an adjustable exhaust fan or blower whose exhaust rate can be adjusted to control the combustion rate of the fuel on the upper fuel retaining surface and thereby cause the undesirable emissions concentration, collected by this means, to be increased.

20. A process of continuously eliminating ash thrugh the lower fuel retaining surface described in claim 5 by constructing this surface of parallel strips of steel or cast iron with the wider strip dimension oriented vertically and the strips running longitudinally downward and where each strip can pivot freely about its upper terminus and where the lower terminus consists of a shaft that runs through holes associated with each strip and the shaft has cam like flats in the vicinity of each hole and these cam like flats alternate 180° between adjacent strips so that, as the shaft rotates, the strips move alternately up and down with respect to each other acting to force ash downward through the surface.

21. A process for controlling combustion, eliminating large foreign objects, aiding the final elimination of ash and the downward propulsion of fuel, in apparatus employing the process claimed by claim 5, that consists of a series of parallel spoke sets, with typically four vanes per set of spokes, located at the lower terminus of the lower fuel surface and where these vanes interleave with the parallel strips that comprise the lower fuel surface and these vanes are affixed to a common rotating shaft to that by adjusting the angular position of the shaft, the various functions described can be performed.

22. A process by which a boiler is inserted into the furnace described by claim 14, in which two parallel rows of boiler pipes are inserted in the heat exchange vertical plane and where ample space is allowed between adjacent boiler pipes to permit common radiant heat visibility between the combustors that comprise the furnace, and where an adjustable reflecting surface is inserted between the two rows of pipes so as to adjust common visibility and hence the combustion rate.

23. A process by which hot air heat exchanger ducts are inserted into the heat exchange vertical plane claimed by claim 14 and where duct windows are set into the ducts through the radiant heat exchange area to permit each combustor to see portions of the combusting fuel on its opposite side and where these window areas are cntrolled by an adjustable shutter for purposes of combustion control and where the combustion gases flow through vertical tubes that traverse within the hot air ducts so as to transfer the heat from the combustion gases to the hot air.

24. The process described in claim 5 or 6 specifically for feeding, combusting and focussing radiant heat from wood logs in which the upper support surface consists of two suitable supported parallel rods, tilted 45° from the gravitational field, and the lower fuel support surface consists of a hinged, grate-like surface tilted roughly 90° away from the average plane angle formed by the rods and upon which is placed a third grill-like or loosely woven steel mesh surface that can be repositioned along the second surface and also tilted at various angles with respect to the second surface where suitable handles permit adjustment of either or both the second and third surface positions.

* * * * *